US009057025B2

(12) United States Patent
Brown

(10) Patent No.: US 9,057,025 B2
(45) Date of Patent: Jun. 16, 2015

(54) PURIFICATION OF AROMATIC FEEDSTOCK

(75) Inventor: Stephen H. Brown, Annandale, NJ (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 152 days.

(21) Appl. No.: 13/186,039

(22) Filed: Jul. 19, 2011

(65) Prior Publication Data

US 2012/0048780 A1 Mar. 1, 2012

Related U.S. Application Data

(60) Provisional application No. 61/377,322, filed on Aug. 26, 2010.

(51) Int. Cl.

| | |
|---|---|
| ***C10G 25/03*** | (2006.01) |
| ***B01J 29/06*** | (2006.01) |
| ***B01J 29/70*** | (2006.01) |

(52) U.S. Cl.

CPC ..... *C10G 25/03* (2013.01); *C10G 2300/201* (2013.01); *C10G 2300/1096* (2013.01); *C10G 2300/4081* (2013.01); *C10G 2400/30* (2013.01)

(58) Field of Classification Search

CPC ..... C10G 2300/1096; C10G 2300/201; C10G 2300/4081; C10G 2400/30; C10G 25/03; B01J 29/06; B01J 29/7038

USPC ..... 208/310 Z, 310 R, 308, 177; 422/129, 422/211, 212

See application file for complete search history.

(56) References Cited

U.S. PATENT DOCUMENTS

| | | | | |
|---|---|---|---|---|
| 6,368,496 | B1 | 4/2002 | Brown et al. | |
| 6,500,996 | B1 | 12/2002 | Brown et al. | |
| 6,781,023 | B2 | 8/2004 | Brown et al. | |
| 7,214,840 | B2 | 5/2007 | Lo et al. | |
| 7,517,824 | B2 | 4/2009 | Brown et al. | |
| 7,731,839 | B2 | 6/2010 | Brown et al. | |
| 7,744,750 | B2 | 6/2010 | Brown et al. | |
| 8,057,664 | B2 * | 11/2011 | Brown et al. | 208/299 |
| 2007/0112239 | A1 | 5/2007 | Brown et al. | |
| 2008/0128329 | A1 | 6/2008 | Brown et al. | |
| 2011/0060177 | A1 | 3/2011 | Kinn et al. | |

OTHER PUBLICATIONS

Green, D. (ed.), Perry's Chemical Engineers' Handbook 8th Ed., 2007, McGraw-Hill, pp. 19-4 & 19-25.*

Perry's Chemical Engineer's Handbook, 2008, 8th ed., McGraw-Hill, pp. 6-32, 11-4, 19-4 & 19-25.*

* cited by examiner

*Primary Examiner* — Walter D Griffin
*Assistant Examiner* — Derek Mueller

(57) ABSTRACT

The invention is a process for removing impurities from an aromatics stream and apparatus for the practice thereof, whereby trace olefins and dienes are removed from aromatic plant feedstocks using a reactor design that enables the product to be backmixed with the feedstock and that enables a feed/effluent heat exchanger.

10 Claims, 2 Drawing Sheets

PURIFICATION OF AROMATIC FEEDSTOCK

PRIORITY CLAIM

This application claims the benefit of U.S. Provisional Application No. 61/377,322, filed Aug. 26, 2010, the entirety of which is incorporated by reference.

FIELD OF THE INVENTION

The invention relates to removing trace olefins and dienes from aromatic feedstocks.

BACKGROUND OF THE INVENTION

In petroleum processing, aromatic streams are derived from processes such as naphtha reforming and thermal cracking (pyrolysis). These aromatic streams also contain undesirable hydrocarbon contaminants including mono-olefins, dienes, styrenes and heavy aromatic compounds such as anthracenes.

The aromatic streams are used as feedstocks in various subsequent petrochemical processes. In certain of these processes, such as para-xylene production, e.g., from an aromatic stream containing benzene, toluene and xylenes (BTX) or toluene disproportionation, hydrocarbon contaminants cause undesirable side reactions. Therefore the hydrocarbon contaminants must be removed before subsequent processing of the aromatic streams.

Moreover, the shift from high-pressure semiregenerative reformers to low-pressure moving bed reformers results in a substantial increase in contaminants in the reformate derived streams. This in turn results in a greater need for more efficient and less expensive methods for removal of hydrocarbon contaminants from the aromatic streams.

Undesirable hydrocarbon contaminants containing olefinic bonds are quantified by the Bromine Index (BI). Undesirable olefins, including both dienes and mono-olefins, have typically been concurrently removed from aromatic streams such as BTX by contacting the aromatic stream with acid-treated clay. Other materials, e.g., zeolites, have also been used for this purpose. Clay is an amorphous naturally-occurring material, while zeolites used for this purpose generally are synthesized and are therefore more expensive. Both clay and zeolites have limited lifetimes in aromatics treatment services. Although clay is much cheaper per se than zeolites, under certain circumstances the choice of zeolites can provide improved performance, making the selection of zeolites an overall better economic choice.

Improvement in using zeolites to remove contaminants from aromatic feeds have been described in numerous patents, such as U.S. Pat. Nos. 6,368,496; 6,500,996; 6,781,023; 7,214,840; 7,517,824; 7,731,839; 7,744,750; U.S. Patent Application Publications 2007-0112239 and 2008-0128329; and U.S. Provisional Application 61/240,424.

Olefin removal devices in use today, designed for use with clay, do not use a feed distribution system. This is because feed distribution does not improve cycle length, as clay beds age in a band-wise fashion. Accordingly, a feed distribution system would just be an additional cost without any benefit. Furthermore, clay can be completely exhausted at a reaction temperature of 205° C. Reactor design heretofore typically provides for a maximum temperature of about 210° C. Increasing the reactor temperature enables only small gains in run length. Achieving a higher temperature requires use of hotter steam in the feed heater and addition of a feed effluent heat exchanger since the product is too hot for optimal integration with aromatics distillation towers.

The present inventor has discovered a process and apparatus for the practice thereof, whereby trace olefins and dienes are removed from aromatic plant feedstocks using a reactor design that enables the product to be backmixed with the feedstock and that has a feed/effluent heat exchanger.

SUMMARY OF THE INVENTION

The invention is directed to a process and apparatus for the practice thereof, whereby trace olefins and dienes are removed from aromatic plant feedstocks by contact of the feedstock with a catalyst comprising at least one zeolite, using a reactor design that in embodiments enables the product to be backmixed with the feedstock and that in embodiments has a feed/effluent heat exchanger. In embodiments, the design uses a feed distributor which in embodiments prevents channeling. While each of these embodiments may be achieved separately, it is preferred that at least two and still more preferably all three embodiments are present in the apparatus.

In embodiments, the design enables the feed to be heated to high temperatures, such as 250° C., significantly higher than the 210° C. maximum feed temperature used in today's reactors, and still provide effective removal.

The ability to recycle the reactor product provides two unexpected benefits. Recirculation of product without addition of fresh feed provides an unexpected means of rejuvenating the zeolite catalyst system. Recirculation of product while processing fresh feed unexpectedly increases cycle length. The inventor speculates that the benefit is achieved by evenly distributing the reaction workload from the top to the bottom of the bed.

It is an object of the invention to provide increased serviceable life to a aromatic feed purification system comprising one or more zeolites.

These and other objects, features, and advantages will become apparent as reference is made to the following detailed description, preferred embodiments, examples, and appended claims.

DETAILED DESCRIPTION

Figure 1:
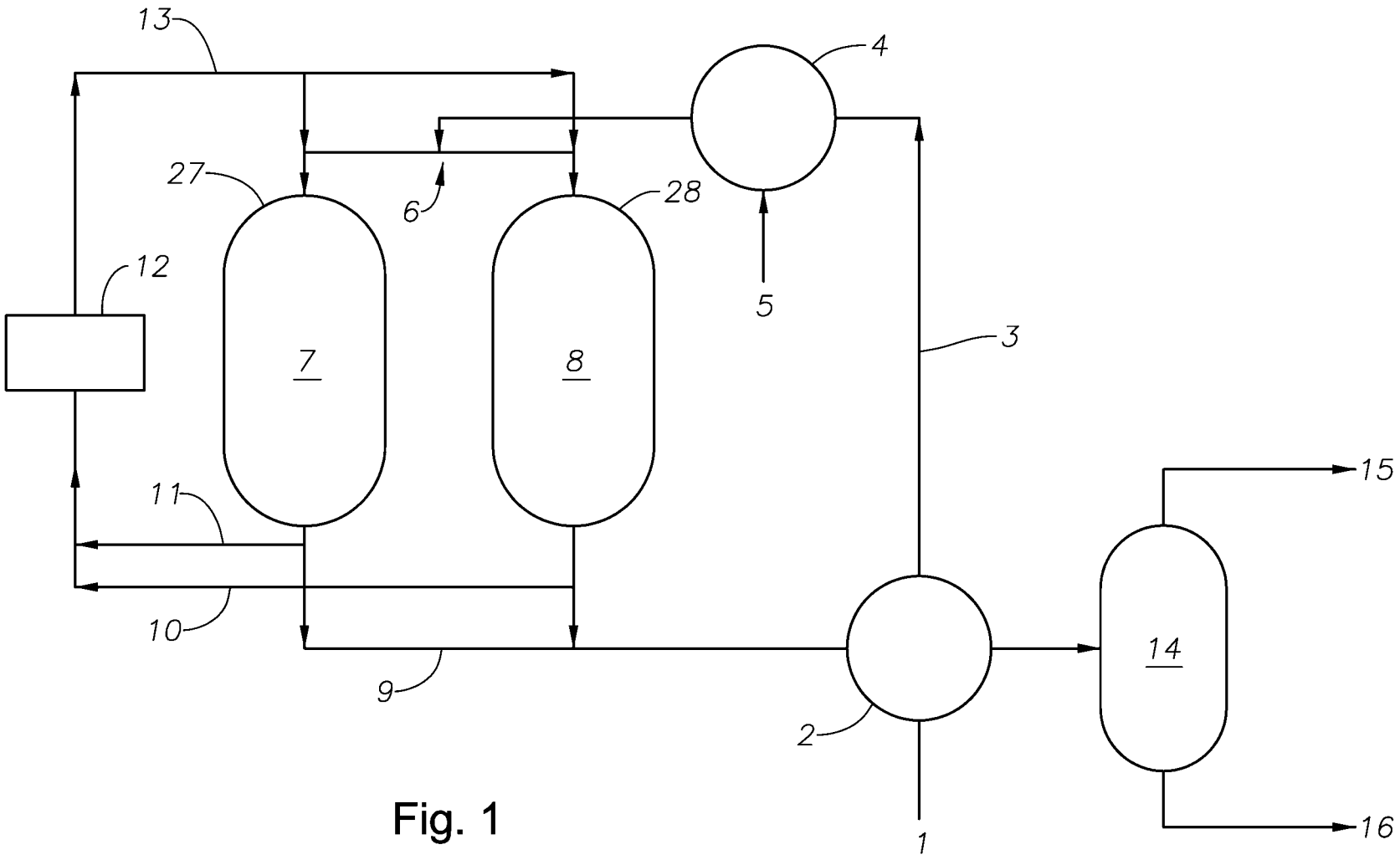
FIG. 1 is a schematic showing an apparatus according to an embodiment of the invention.

According to the invention, there is a process for removing impurities from an aromatics stream and apparatus for the practice thereof, whereby trace olefins and dienes are removed from aromatic plant feedstocks (also known in the art as reduction of Bromine Index or BI of said feedstock) by contact with at least one zeolite in a reactor that enables the product to be backmixed with the feedstock and that provides a feed/effluent heat exchanger.

In the present invention, a feed/effluent heat exchanger is added to prevent the product from upsetting the distillation column when the product temperature exceeds 205° C. Current clay treater reactor design, modified by adding zeolite or replacing clay with zeolite, has a feed pre-heater capable of heating the feed generally to a maximum of 205° C., although in some cases it may operate as high as 220° C. The product is passed directly into a distillation column. All the heat in the product is used during the distillation. The product is depressured when distilled. Only minimal flashing occurs under ordinary operating conditions of existing clay treater reactors retrofitted with catalysts comprising zeolite. The present inventor has thus discovered a simple and effect way of more effectively utilizing the benefits of a catalyst comprising zeolite and exceeding the prior art reactor temperature and operating even as high as 300° C.

In addition, current clay treater design has no feed distributor. The feed enters the vessel through a large pipe. This is sufficient when using clay treaters because the clay undergoes band wise aging. Band wise aging means that when the unit is restarted with a fresh clay, the top of the clay bed reduces contaminants below the specification and the rest of the clay bed is not exposed to these contaminants. After a week on stream, the top of the clay bed is nearly completely inactive, having filled with coke, and a small section of the clay bed between the top and the bottom is removing the contaminants. The zone of clay removing the contaminants as required moves from the inlet toward the outlet as the run progresses. In other words, conversion activity is limited to a "band" which moves down the bed with time—hence band-wise aging. In contrast, with catalyst comprising zeolite, one of the benefits over clay is that the entire bed is utilized because zeolite does not age in band-wise fashion. Accordingly there is benefit to be gained by having feed distributors.

The fluid distributor may take a number of forms, such as, for example, screens, grids, perforated plates, and the like. The fluid distribution serves several objectives. It is intended to distribute the fluids passing downwardly through the reactor evenly across the horizontal plane of the catalyst layer, serves to insure the break-up of any gas bubbles and the prevention of jet action on the catalyst bed, and it insures optimal mixing of the fluids, i.e., recycle and fresh feed. Such feed distribution systems are per se known, such as U.S. Pat. Nos. 6,554,994 and 6,063,263. As used herein, then, the expression "substantially evenly distributed" is intended to mean that the fluid is distributed over the top of the catalyst bed so as to substantially achieve the above objective, and the adjective "substantially" should be taken to mean that one of ordinary skill in the art, having the present disclosure before them, would be able to engineer a distribution device so to achieve these objectives.

The preferred catalyst for treatment to substantially remove mono-olefins is selected from the MWW family of zeolites, which are per se well known. More preferably the catalyst is MCM-22, MCM-36, MCM-49, MCM-56, EMM-10, and mixtures thereof. Such catalysts have been described in numerous patents and publications, such as U.S. Pat. No. 4,954,325, U.S. Pat No. 5,229,341, U.S. Pat. No. 5,236,575, and U.S. Pat. No. 5,362,697.

After treatment to remove mono-olefins the resultant stream is distilled to obtain the product, which is preferably an overhead stream comprising C8 product.

Current clay treater designs do not recycle effluent back through the reactor because there is no particular benefit to be achieved. In contrast, recycling product using a catalyst comprising zeolite is highly beneficial. However, recycling olefin-free product rejuvenates the catalyst comprising zeolite (illustrated in the experimental section below).

In embodiments, the catalyst is also mixed with a clay. In the alternative, the clay and zeolite could be separated from each other, such as in the same reactor or in different reactors, and also the clay may be upstream or downstream of the zeolite. Any clay suitable for processing hydrocarbons can be used, preferably Engelhard F-24 clay, Filtrol 24, Filtrol 25, and Filtrol 62, Attapulgus clay or Tonsil clay, with Engelhard F-24 clay being the most preferred. The catalyst may comprise a mixture of clay and zeolite having an outer layer of mostly clay or an outer layer of mostly zeolite or an intimate mixture of clay and zeolite, and in embodiments the proportion of zeolite:clay may range from about 5:95 to about 95:5 or 10:90 to 90:10, with a preferred range being from 30:70 to 50:50. In some embodiments no clay is present. The ratios as used herein are mass ratios unless otherwise indicated.

In embodiments, the zeolite is a regenerated or rejuvenated zeolite. Such zeolites are known in the prior art per se and are discussed, for instance, in U.S. Pat. Nos. 6,900,151 and 7,517,824, and U.S. Patent Publication 2008-0029437. It may also be fresh zeolite or a mixture of fresh, regenerated, or rejuvenated in all possible proportions. One of ordinary skill in the art in possession of the present disclosure can determine the appropriate proportions for a particular need without undue experimentation. As used herein, the term "regenerated catalyst" means any catalyst that has gone through at least one regenerative process, such as an oxidative process sufficient to regenerate the catalyst, including but not limited to traditional coke burn regen. The term "rejuvenated catalyst" means any catalyst that has gone through at least one rejuvenation process, including but not limited to an inert reductive agent under conditions sufficient to rejuvenate the catalyst. In an embodiment, the present invention includes a step of contact of said catalyst bed with a sufficient amount of recycle and for a sufficient time to rejuvenate and/or regenerate said catalyst. In this manner, the BI reduction capacity of the catalyst is restored to a predetermined level.

The present invention may be better understood by reference to the following examples and accompanying figures, which are exemplary of the present invention and should not be taken as limiting thereof.

In FIG. 1, the aromatic feedstream 1 to be purified is first passed through an optional heat exchanger 2 where the feed takes heat from purified stream 9 as it passes from the zeolite beds 7 and 8 through to still 14. The heat exchanger 2 may also have a supplemental source of heat, such as steam. The heat exchanger 2 (as well as heat exchanger 5, discussed below) may be of the type per se known in the art. The feedstream 3 heat-exchanged with 9 then may be heated by steam 5, by way of example, provided to heat exchanger 4 and passed at junction 6 to the zeolite bed reactors 7 and 8, the reactors having distributors 27 and 28, respectively. All or a portion of the purified aromatics stream may then be sent via conduit 9 to still 14 and/or all or a portion of the same may be recycled, via conduits 10 and 11 with the aid of recycle pump 12 and then via conduit 13 to be distributed between the reactors 7 and 8. The nature of the overheads 15 and bottoms 16, of course, varies depending on the feed and operating conditions of the system and particularly the operating conditions of the still. In the case of a heavy reformate feed 1 the overheads 15 would primarily be xylenes and the bottoms product 16 would be C9+ aromatics. In the case of a benzene extract feed 1 the overheads 15 would be primarily benzene and the bottoms product 16 would be C7+ aromatics.

Good distribution of the feed is needed to make the best use of the zeolite catalyst. When recycle operation is used, the distributors play an important role ensuring that the fresh feed (stream 1) is well mixed with recycle stream 13. There are many efficient distributor designs known to those skilled in the art. One example is a "shower head" design that provides an even spray of liquid feed across the top of the catalyst bed. Other common designs use perforated trays, or a series of pipes with uniform sized holes (similar to a common lawn sprinkler).

The following are experiments intended to be representative of the present invention and not limiting thereof.

Example 1

The reaction of benzene with ethylene was used to model the reaction of benzene, toluene, and xylenes with C6+ isoolefins that occur in aromatics plant treatment units. Liquid feedstocks were prepared from benzene, 2-methyl-pentane, 2,3 dimethylbutane, and methylcyclopentane. The feedstock compositions are provided in Table 1, below. These feedstocks were blended with ethylene at mole ratios of ethylene to benzene of 0.5:1 and 1:1. The blended feedstock was processed at 2-10 WHSV, 250 psig, >98% ethylene conversion, and 350-400° F. (about 177-204° C.). The catalyst was an MCM-22 family molecular sieve. The experiments were conducted in a standard laboratory fixed bed reactor. The liquid feed was delivered from a 500 cc syringe pump. The reactor was constructed from a two foot long section of ⅜" stainless steel tube. The reaction zone was heated with a three zone electrical furnace.

TABLE 1

| Feed Compositions | | |
|---|---|---|
| Model Isoparaffin | 2,3-Dimethylpentane | 3-Methylpentane |
| Nominal Composition, wt % | | |
| 3-Methylpentane | — | 49.5 |
| Methylcyclopentane | 1.0 | 1.0 |
| Benzene | 49.5 | 49.5 |
| 2,3-Dimethylpentane | 49.5 | — |
| Composition wt % | | |
| 2-Methylpentane | — | 0.047 |
| 3-Methylpentane | — | 43.791 |
| N-Hexane | 0.008 | 0.055 |
| Methylcyclopentane | 0.923 | 0.939 |
| 2,2-Dimethylpentane | 0.079 | — |
| Benzene | 51.718 | 55.163 |
| 3,3-Dimethylpentane | 0.020 | — |
| Cyclohexane | 0.012 | — |
| 2,3-Dimethylpentane | 47.021 | — |
| 3-Methylhexane | 0.183 | — |
| Toluene | — | 0.006 |
| Other $C_7$ | 0.037 | — |
| Total | 100.001 | 100.001 |
| EB Impurities*, ppmw | | |
| Range = 0 vs Range = 4 | 21 | 20 |
| Internal Standard | 34, 30 | — |

Figure 2:
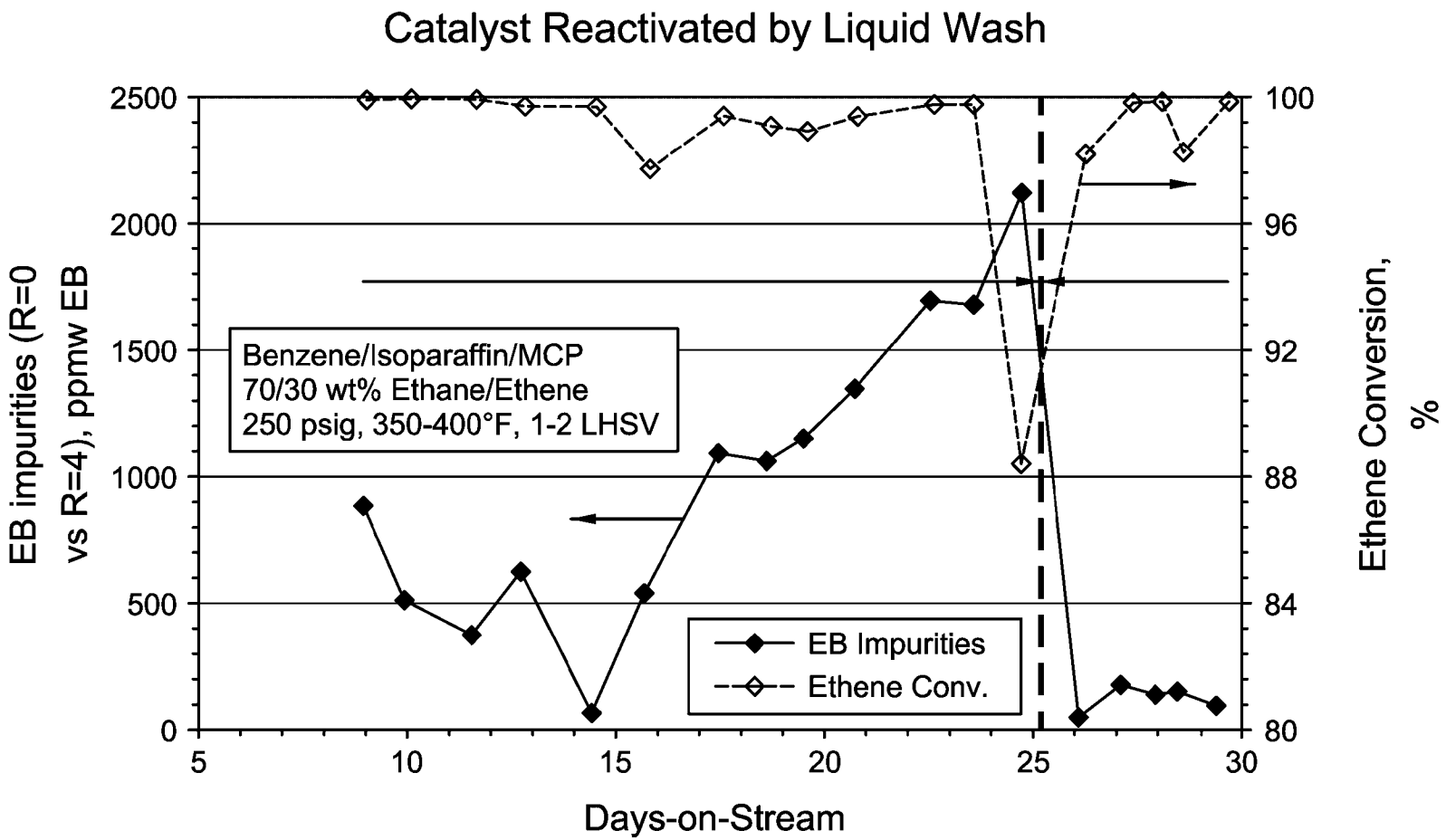
FIG. 2 is a plot of catalyst performance over time on stream for an embodiment of the process according to the invention.

*All non-EB compounds eluting between toluene and cumene on a boiling point column Catalyst performance vs. time on stream is plotted in FIG. 2. The catalyst aged steadily during the first 24 DOS (days-on-stream) as evidenced by rising levels of impurities between days 11 and 24 (solid diamonds read off the left y-axis) and a steep fall off in ethylene conversion after 24 DOS (open diamonds read off the right y-axis). At this time, ethylene was removed from the feedstock while remaining at constant temperature, pressure, and benzene flowrate for 12 hrs. This 12-hour period is represented on the graph by the vertical dashed line just past 25 days on stream. Then the initial experiment was resumed. Surprisingly, this procedure restored the catalyst to fresh activity and selectivity.

The example demonstrates that olefin-free benzene feedstock rejuvenates MCM-22 catalyst used for aromatics alkylation in the liquid phase at 205° C.

The process of the invention provides a pure stream of aromatics as the product. In the reactor, olefin and diene contaminants react with aromatics to form larger aromatic molecules. Example one teaches that circulation of the olefin free stream at reaction temperature and pressure for several days rejuvenates MCM-22 catalyst. The rejuvenated MCM-22 catalyst can then be restreamed with olefin and diene containing feedstock. This procedure is much less expensive than unloading, regenerating, and reloading. After several rejuvenations the catalyst will need to be removed for standard regeneration.

Comparative Example 2

A xylenes plant heavy reformate feedstock with a BI of 1000 is treated over an MCM-22 catalyst in the reactor of the invention at 2 LHSV, 300 psig, and 205° C. The BI of the xylenes produced from the reactor effluent is monitored with time on stream. After 200 days, the BI of the xylenes reaches the end of cycle specification of 20.

Example 3

The procedure of Example 2 is repeated except the unit is run with 3 volumes of recycle for each volume of fresh feedstock. After 300 days, the BI of the xylenes approaches 20. At this point the recycle is stopped. The xylenes BI drops below 10 because the contaminant olefins now have a four times longer residence time. After 400 days, the BI of the xylenes reaches the end of cycle specification of 20. The example surprisingly doubles the catalyst cycle length.

While the illustrative embodiments of the invention have been described with particularity, it will be understood that various other modifications will be apparent to and can be readily made by those skilled in the art without departing from the spirit and scope of the invention.

All patents and patent applications, test procedures (such as ASTM methods, UL methods, and the like), and other documents cited herein are fully incorporated by reference to the extent such disclosure is not inconsistent with this invention and for all jurisdictions in which such incorporation is permitted. Trade names used herein are indicated by a ™ symbol or ® symbol, indicating that the names may be protected by certain trademark rights, e.g., they may be registered trademarks in various jurisdictions. When numerical lower limits and numerical upper limits are listed herein, ranges from any lower limit to any upper limit are contemplated.

What is claimed is:

1. A process for the purification of an aromatic feedstock by contact of said feedstock with a catalyst bed comprising at least one zeolite to produce a reactor effluent having a lower BI index when compared with said feedstock, and then distilling said reactor effluent to provide an overhead consisting essentially of substantially pure aromatic hydrocarbon product, the improvement comprising: (i) a feedstock distributor upstream of said catalyst bed, whereby the feedstock is substantially evenly distributed over the top of said catalyst bed, and (ii) wherein said reactor effluent and/or said substantially pure product are fluidly connected with said catalyst bed to provide recycle, wherein said recycle rejuvenates said catalyst and reduces the requirement to regenerate said catalyst by at least 50%.

2. The process according to claim 1, wherein said at least one zeolite is selected from MWW structure zeolites.

3. The process according to claim 2, wherein said at least one zeolite is selected from MCM-22 structure zeolites.

4. The process according to claim 1, wherein said bed further includes a clay.

5. The process according to claim 1, including a step of contact of said catalyst bed with a sufficient amount of recycle and for a sufficient time to rejuvenate said catalyst bed.

6. The process according to claim 1, wherein said contact occurs with said feedstream at a temperature of greater than 220° C.

7. The process according to claim 1, wherein said contact occurs with said feedstream at a temperature of greater than 240° C.

8. The process according to claim 1, wherein said contact occurs with said feedstream at a temperature of greater than 260° C.

9. The process according to claim 1, wherein said contact occurs with said feedstream at a temperature of greater than 280° C.

10. The process according to claim 1, wherein a feedstock/effluent heat exchanger is provided, whereby heat from the reactor effluent is exchanged with said feedstock.

* * * * *